US006206227B1

(12) United States Patent
Ferri, Jr.

(10) Patent No.: US 6,206,227 B1
(45) Date of Patent: Mar. 27, 2001

(54) CLOSURE ASSEMBLY FOR PRESSURE VESSEL

(76) Inventor: Edward T. Ferri, Jr., 12390 Calle Celestina, Gilroy, CA (US) 95020

( * ) Notice: Subject to any disclaimer, the term of this patent is extended or adjusted under 35 U.S.C. 154(b) by 0 days.

(21) Appl. No.: 09/236,576

(22) Filed: Jan. 26, 1999

Related U.S. Application Data

(63) Continuation-in-part of application No. 09/167,731, filed on Oct. 7, 1998.

(51) Int. Cl.[7] ..... B65D 43/14; B65D 53/02; F17C 1/00

(52) U.S. Cl. ..... 220/581; 220/213; 220/232; 220/240; 220/345.6; 220/349

(58) Field of Search ..... 220/581, 213, 220/232, 252, 315, 345.1, 349, 345.6, 351, 4.12, 582, 240, 378, 4.04, 584, 592

(56) References Cited

U.S. PATENT DOCUMENTS

| | | | | |
|---|---|---|---|---|
| 1,895,169 | * | 1/1933 | Mosel | 220/213 |
| 3,050,211 | * | 8/1962 | Hutterer | 220/213 X |
| 3,623,627 | * | 11/1971 | Bolton | 220/252 |
| 3,827,182 | * | 8/1974 | Van Helleputte | 220/213 X |
| 3,861,654 | * | 1/1975 | Singleton | 220/213 X |
| 3,948,749 | * | 4/1976 | Sargewnt | 220/213 X |
| 4,150,509 | * | 4/1979 | Knap | 49/123 |
| 4,263,885 | * | 4/1981 | Gillis et al. | 220/213 X |
| 4,457,444 | * | 7/1984 | Wold | 220/213 |

* cited by examiner

*Primary Examiner*—Allan N. Shoap
*Assistant Examiner*—Niki M. Eloshway
(74) *Attorney, Agent, or Firm*—Peter A. Borsari

(57) ABSTRACT

A closure assembly for a pressure vessel having an opening in the external surface thereof, comprising a concentric guide track secured to the external surface of the pressure vessel, a curved concentric closure or door configured to conform to the curvature of the pressurized tank, means for interlocking the concentric door to the pressure vessel when the door is in the closed position and an inflatable seal that fills the void between the door and the pressurized tank when the door is closed and the seal inflated. The concentric guide track includes upper and lower concentric tracks upon which the concentric door is mounted and capable of moving along the track such that it can be rotated to the back of the pressure vessel when in the opened position and rotated to close and seal the opening within the pressure vessel in the closed position. Door restraining flanges are provided which correspond and interact with the leading and trailing edges of the concentric door in order to interlock the door to the pressure vessel when the door is closed. Once the pressure vessel is pressurized, the concentric door is pressed against the restraining flanges and the forces of pressurization are transferred from the interlocked concentric door to the pressure vessel.

14 Claims, 8 Drawing Sheets

CLOSURE ASSEMBLY FOR PRESSURE VESSEL

RELATED APPLICATION

This application is a continuation-in-part of U.S. patent application Ser. No. 09/167,731, filed Oct. 7, 1998.

FIELD OF INVENTION

The present invention relates to a closure assembly for sealing a vessel, in particular a tank which is to be pressurized. More specifically, the closure assembly comprises a retainer or guide track system secured to the external surface of the pressure vessel, a concentric door conforming to the basic curvature of the tank, the concentric door being mounted to the guide track system such that it rotates along the guide track and means for interlocking the door to the pressure vessel when the door is closed in such a manner that the load created when the vessel is pressurized is transferred from the door to the tank.

BACKGROUND OF THE INVENTION

U.S. Pat. No. 3,623,627 to Bolton discloses a door construction for a pressure vessel. As shown by Bolton, the vessel has two openings each of which is closed and sealed by means of a door member mounted on tracks which are secured to the interior wall of the pressure vessel. Each opening is surrounded by a seal assembly having a grooved member on the interior surface of the vessel such that when the door is closed, the door member is urged against the grooved member by cam members attached to the tracks. The seal assembly then is urged into contact with the adjacent surfaces of the door member to provide a pressure tight seal between the door member and the vessel wall. There are several drawbacks to the door construction disclosed by Bolton. First and foremost, the design and configuration of the interior mounted tracks significantly restricts the size of the door member which in turn restricts the size of the opening, thereby limiting access to the interior of the vessel and limiting the size of a container which can be placed within the pressure vessel. In addition, Bolton does not provide any means to interlock the door's edges between the track's guide rails, thereby restricting the distance between track's guide rails and preventing a high length to width ratio of the door dimensions. Thus, Bolton's door construction can not be applied to large openings in tall cylindrical pressure vessels. Further, in order to transfer the forces of pressurization to the edge of the door opening of the pressure vessel, Bolton's door construction must be located on the interior surface of the vessel, again limiting the size of the door opening. Bolton's configuration also requires that the addition of special cam members having inclined surfaces to be secured to the tracks in order to seal the opening; these cam members interact with the door member's wheels in order to urge the door member laterally away from the track and into contact with a seal holder. Moreover, the interior mounting of the door construction not only exposes the door member and it's tracking mechanism to any corrosive or deleterious vapors in the pressure vessel, but also obstructs and interferes with the mounting and use of wall attachments located on the interior surface of the pressure vessel.

U.S. Pat. No. 3,050,211 to Hutterer discloses a washing machine door having a curved shell door slidably mounted on runners on the exterior surface of the washing mean. The door is provided with a flexible sealing member which can be inflated in order to provide a "fluid tight" seal for the washing machine. However, the curved door is not designed to transfer the load from the washing machine to the door and guide track.

Despite the teachings of the prior art, a need still exists for a closure assembly for sealing a pressure vessel which can accommodate various size tanks, including, for example, large tanks capable of housing a 55 gallon drum and should be designed to provide coverage of very large door openings relative to the size of the pressure vessel. Such a closure assembly should be capable of quickly and efficiently creating a pressure tight seal between the vessel and the closure. Moreover, such a closure assembly should be mountable in such a manner that it does not require the use of hinges or latches and does not necessitate door swing. In addition, such a closure assembly should be configured in such a manner that the forces of pressurization are transferred from the door to the pressure vessel.

SUMMARY OF THE INVENTION

Accordingly, it is an object of the present invention to provide a closure assembly for a pressure vessel which can accommodate very large openings relative to the size of the pressure vessel.

It is another object of the present invention to provide a closure assembly for a pressure vessel in which the opening of the pressure vessel is sufficiently large to allow for the placement and removal of a 55 gallon drum.

It is yet another object of the present invention to provide a closure assembly for a pressure vessel which quickly and efficiently creates a pressure tight seal between the vessel and the closure.

It is an additional object of the present invention to provide a closure assembly for a pressure vessel which transfers the forces of pressurization from the door to the pressure vessel when the closure assembly is closed and sealed and the vessel is pressurized.

It is a further object of the present invention to provide a closure assembly for a pressure vessel in which the leading and trailing edges of the closure are interlocked to the pressure vessel when the closure is in the closed position.

It is another object of the present invention to provide a closure assembly for a pressure vessel which does not require the use of hinges or latches and which eliminates the problem of door swing, thereby reducing the functional foot print requirement of the pressure vessel.

It is still another object of the present invention to provide a closure assembly which is mounted to the exterior of the pressure vessel in order to avoid interference with internal mountings within the pressure vessel.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

Figure 2:
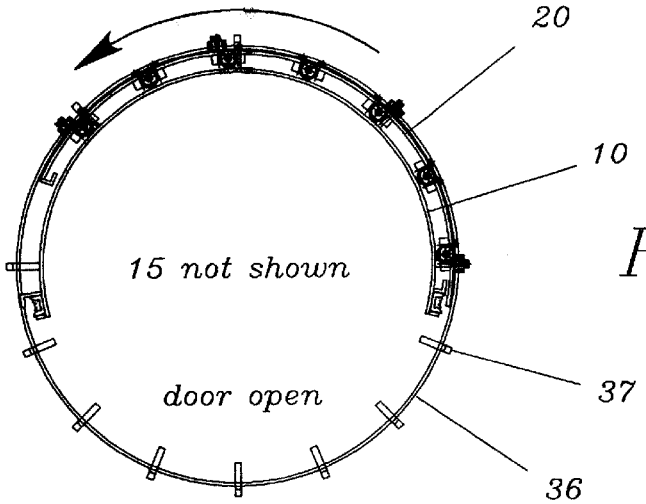
FIG. 2 is a top sectional view taken along the line A—A of FIG. 1 of the pressurized tank of the present invention when the concentric door is open.
Figure 1:
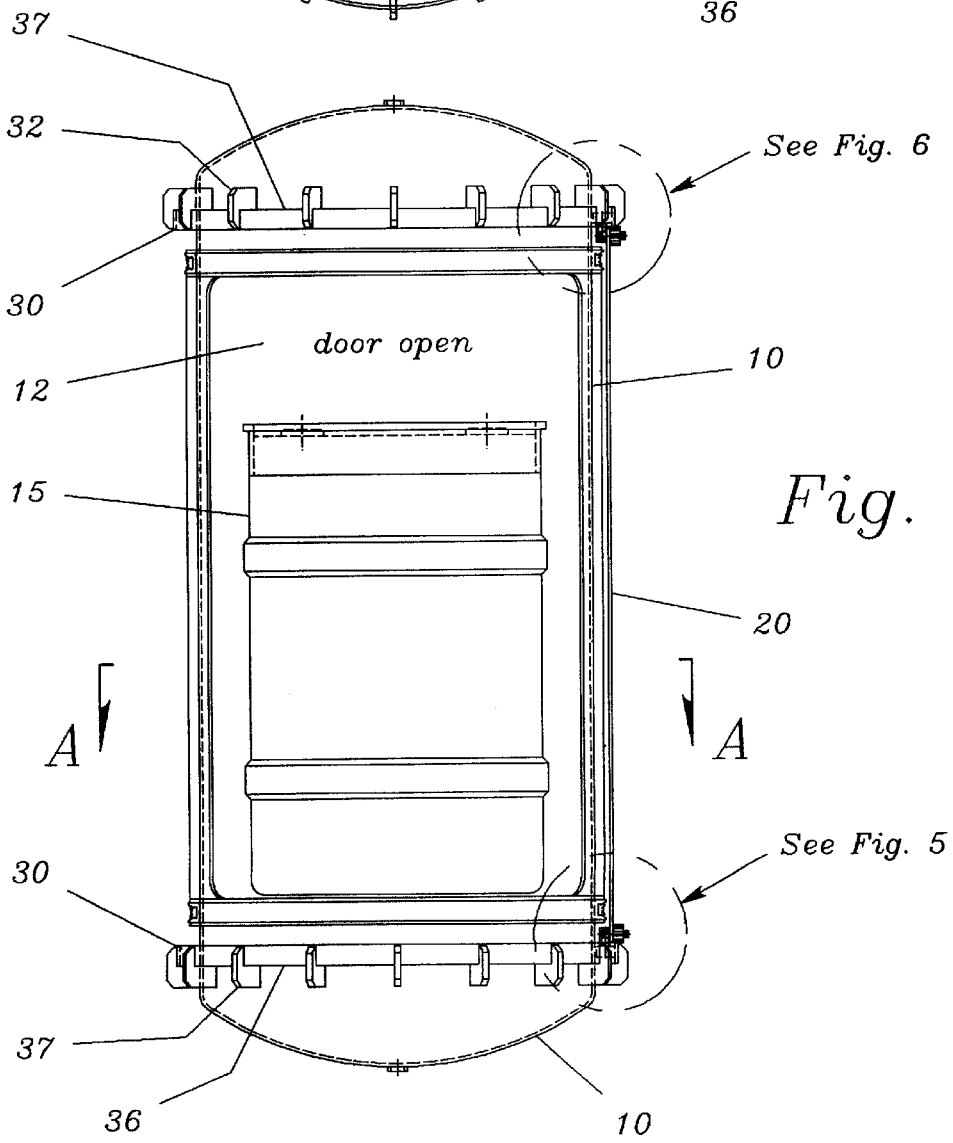
FIG. 1 is a front view of the pressurized tank of the present invention when the concentric door is open.

The present invention relates to a closure assembly for a pressure vessel, such as a pressurizable tank. As shown in FIG. 1, a pressure vessel 10 (hereinafter sometimes referred to as a pressurizable tank) comprises an opening 12 which is of sufficient size that a chemical drum or similar container 15 can be introduced into and removed from the pressure vessel. As described in copending application Ser. No. 09/167,731, the drum 15 may be any container in which liquid chemicals are stored and shipped and the drum itself does not have to be a pressurizable container. Suitable containers include for example, bulk shipping containers, for instance, the standard 55 gallon drum, as well as collapsible bladders.

Figure 3:
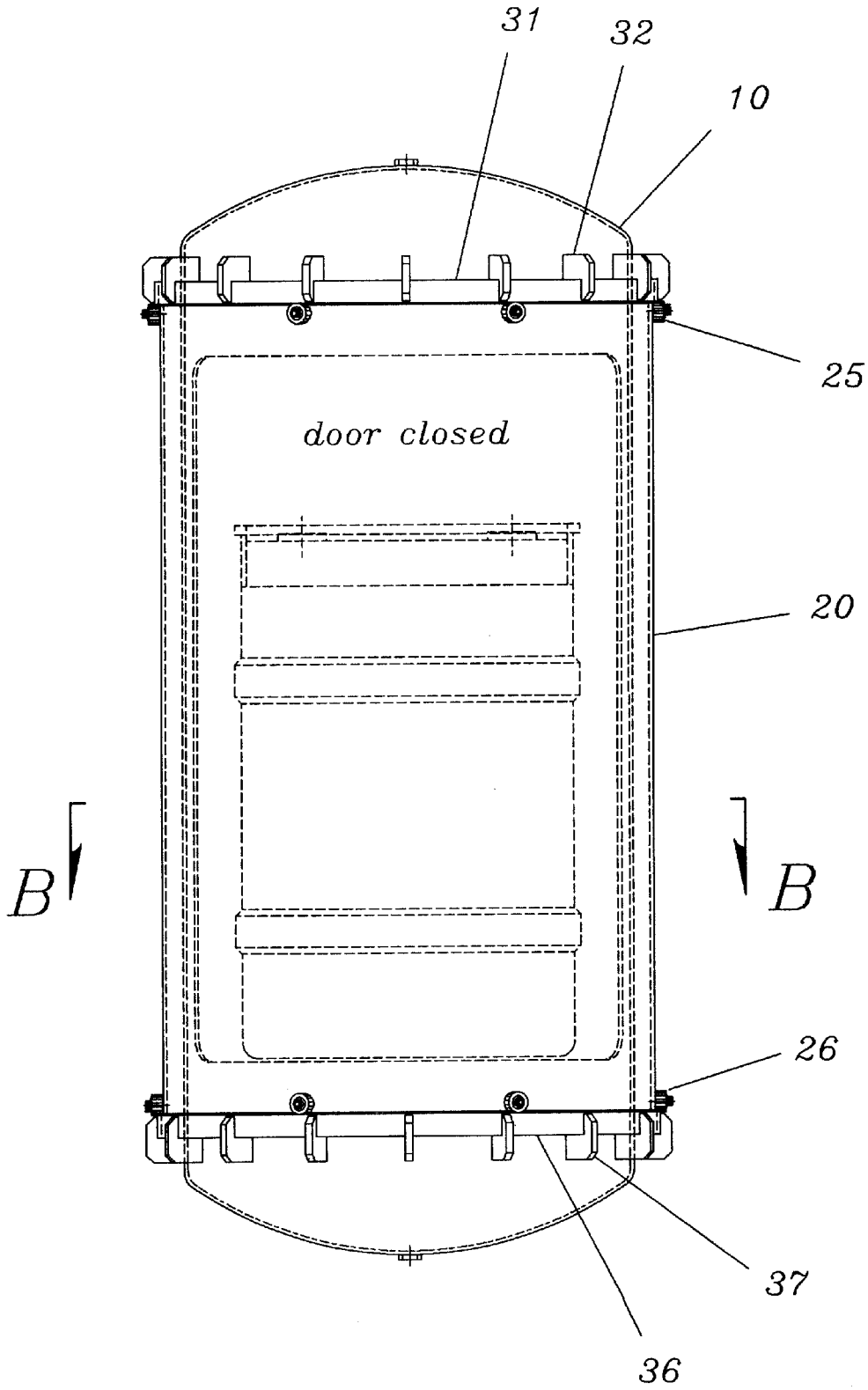
FIG. 3 is a front view of the pressurized tank of the present invention when the concentric door is closed.
Figure 4:
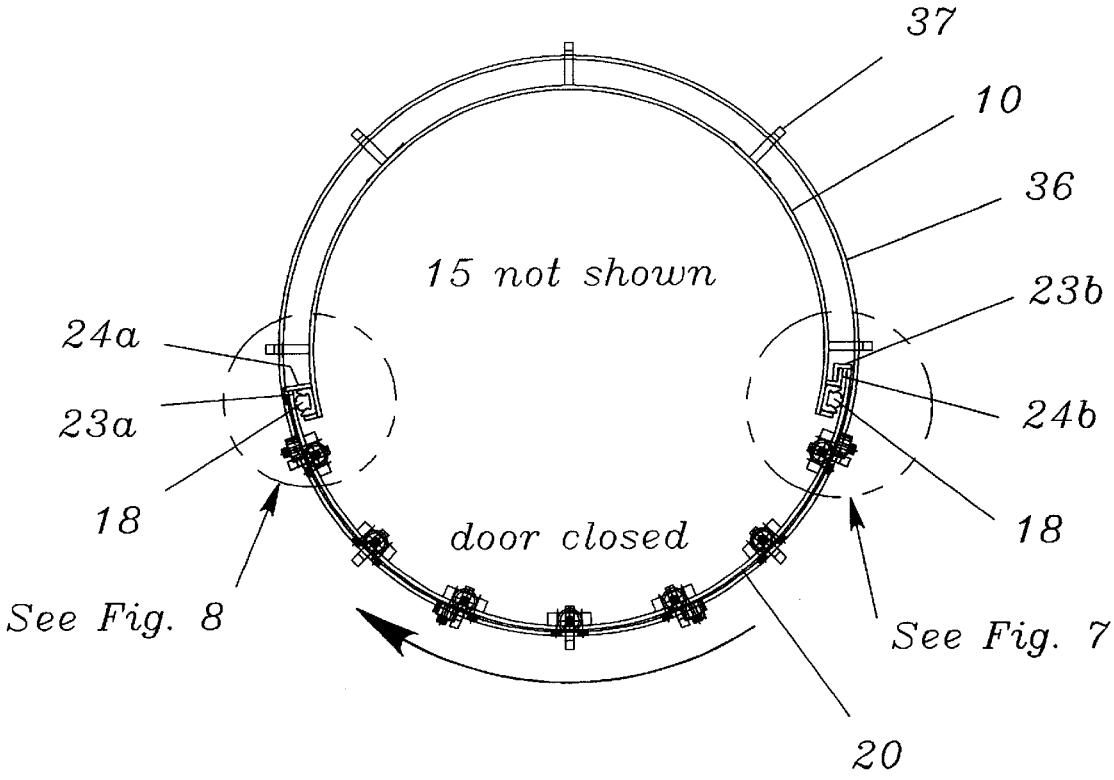
FIG. 4 is a top sectional view taken along the line B—B of FIG. 3 of the pressurized tank of the present invention when the concentric door is closed.
Figure 6:
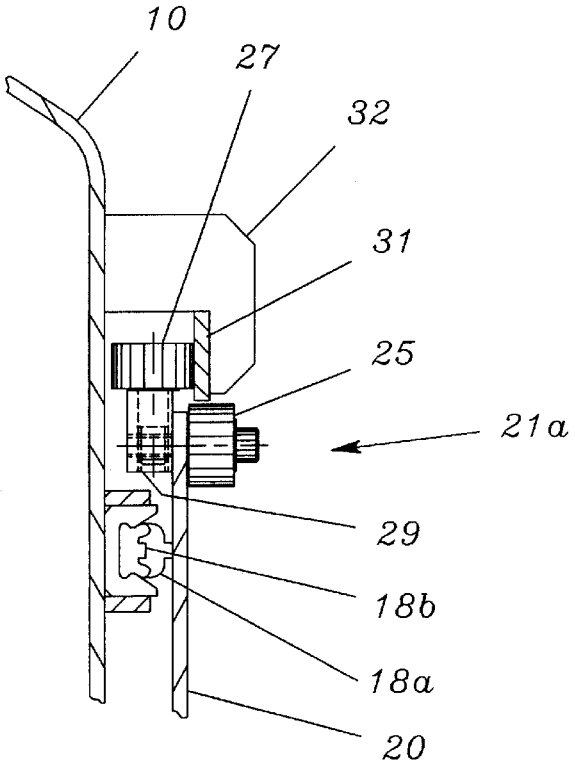
FIG. 6 is an exploded side sectional view of the detailed area of FIG. 1.
Figure 5:
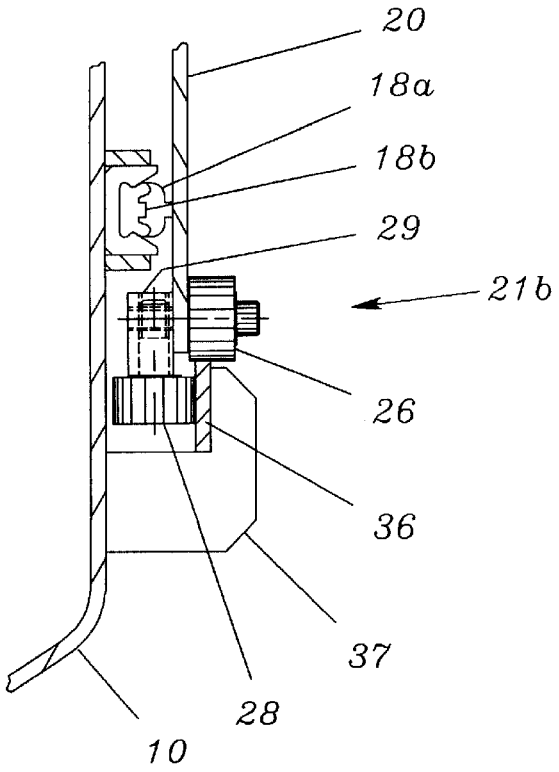
FIG. 5 is an exploded side sectional view of the detailed area of FIG. 1.

Referring to FIGS. 1 to 10, the closure assembly of the present invention is configured in such a manner that facilitates easy access to the interior of the tank 10 and which quickly and efficiently properly seals opening 12 prior to pressurization of tank 10. The closure assembly comprises a concentric guide track 30 secured to the external surface of the pressure vessel 10, a curved concentric closure or door 20 configured to conform to the curvature of the pressurized tank, means for interlocking the door edges to the pressure vessel when the door is in the closed position and an inflatable seal 18 that fills the void between the door and the pressurized tank when the door is closed and the seal inflated. As best seen in FIGS. 4 to 6, the concentric door 20 comprises a top portion 21*a*, a bottom 10 portion 21*b*, a leading edge 23*a* and a trailing edge 23*b*. The concentric door 20 is mounted upon the concentric guide track 30 such that the door can be rotated along the pressure vessel's exterior surface and to the back side of the tank, thereby exposing the opening 12. Since the door 20 conforms to the curvature of the tank and rotates about the circumference of the tank, door swing issues are eliminated, thereby offering a reduced footprint.

Referring to FIG. 3, the concentric guide track 30 comprises an upper concentric track 31 and a lower concentric track 36. The upper concentric track 31 is secured to the external surface of tank 10 by a plurality of retainer ring mounting brackets 32 and the lower concentric track 36 is secured to the external surface of the tank by a plurality of retainer ring mounting brackets 37. The concentric door 20 is supported on the lower guide track 36 by high capacity load bearing cam followers, hereinafter referred to as door support guide rollers 26, which are mounted horizontally and radially from the center of the tank. Door 20 is retained within the upper and lower concentric tracks 31 and 36 by additional cam followers, hereinafter referred to as door retaining guide rollers 27 and 28 which are mounted vertically to the top portion 21*a* of the door (retaining guide rollers 27) and to the bottom portion 21*b* of the door (retaining guide rollers 28). The door retaining guide rollers 27 and 28 are attached to the door by suitable securing means as is well known in the art, including for example, mounting blocks 29 and extend vertically behind the upper concentric track 31 and lower concentric track 36, thereby retaining the door within the concentric track guide 30. Essentially, the support guide rollers 26 collectively function as a roller bearing when the door is being opened or closed while the retaining guide rollers 27 and 28 transfer the load created when the tank is pressurized to the plurality of retainer ring mounting brackets 32 and 37. The guide rollers 27 and 28 are positioned in such a manner that when the door is closed, they are aligned with the ring mounting brackets 32 and 37 in order to directly transfer the forces from the door to the pressurized tank 10. A plurality of horizontally and radially positioned cam followers, hereinafter referred to as upper door guide rollers 25 are secured to the top portion 21*a* of door 20 and correspond to door support guide rollers 26. Guide rollers 25 insure vertical location and positioning of the concentric door 20 but do not provide load support as do the corresponding support guide rollers 26. Of course, as will be obvious to one skilled in the art, the orientation of the concentric door can be modified to correspond to a different orientation of the tank assembly without departing from the spirit of the present invention. For instance, a tank assembly oriented horizontally would require that the concentric door be oriented horizontally. Thus, the load support for the concentric door would be modified to accommodate the different orientation of the tank assembly. Accordingly, it is to be understood that although the description above relates to a vertically disposed concentric door, differing orientations of the concentric door corresponding to differing orientations of the tank assembly are contemplated to be within the scope of the present invention.

Figure 7:
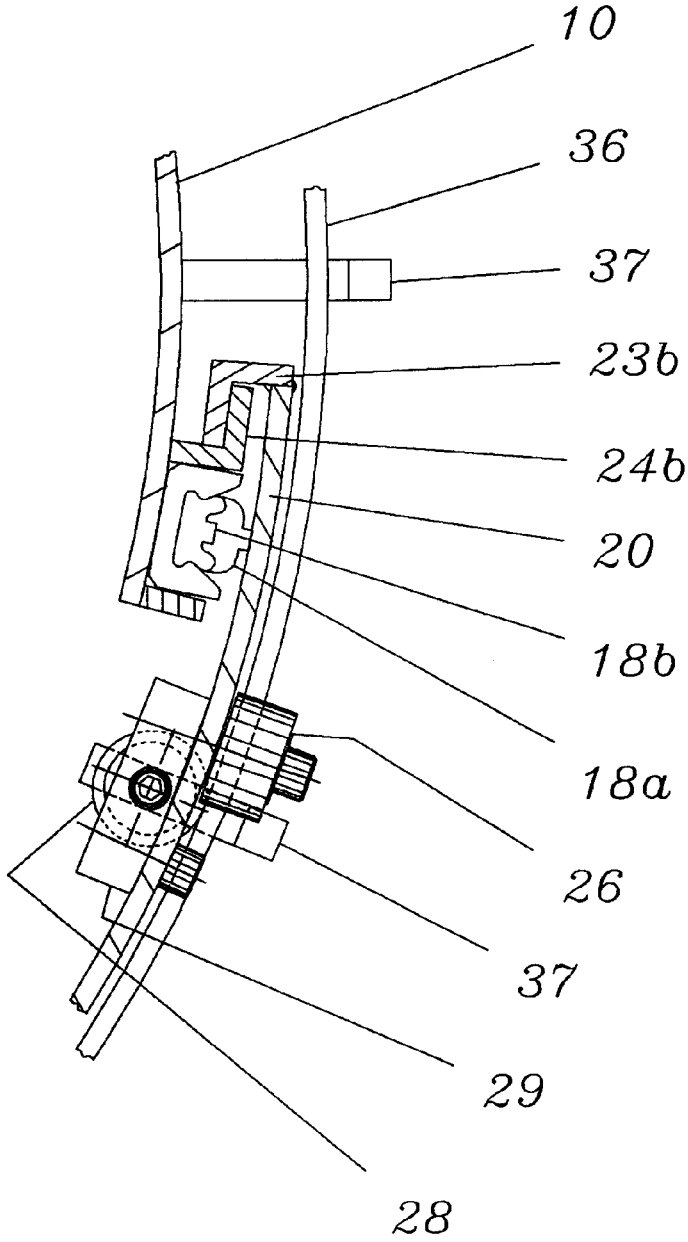
FIG. 7 is an exploded top view of a first detailed area of FIG. 4.
Figure 8:
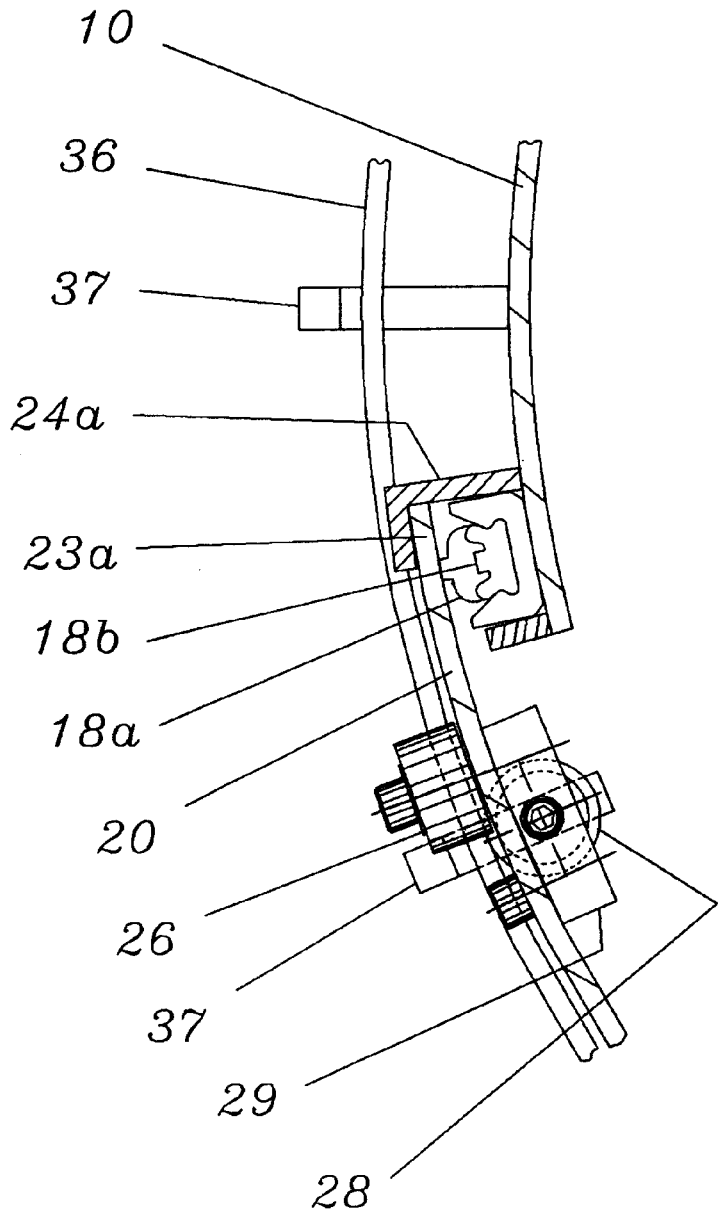
FIG. 8 is an exploded top view of the second detailed area of FIG. 4.
Figure 9:
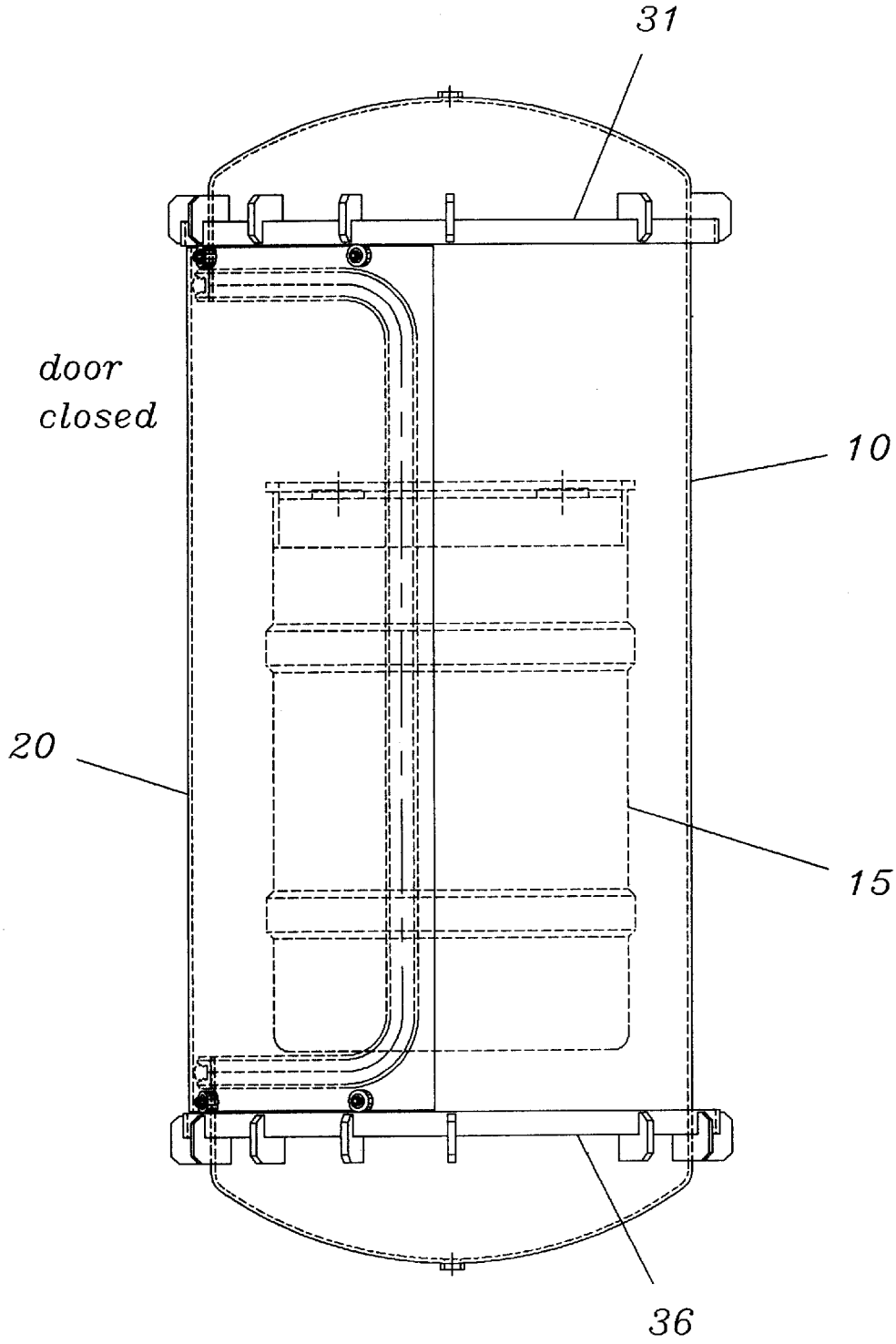
FIG. 9 is a side view of the view of the pressurized tank of the present invention when the concentric door is closed.
Figure 10:
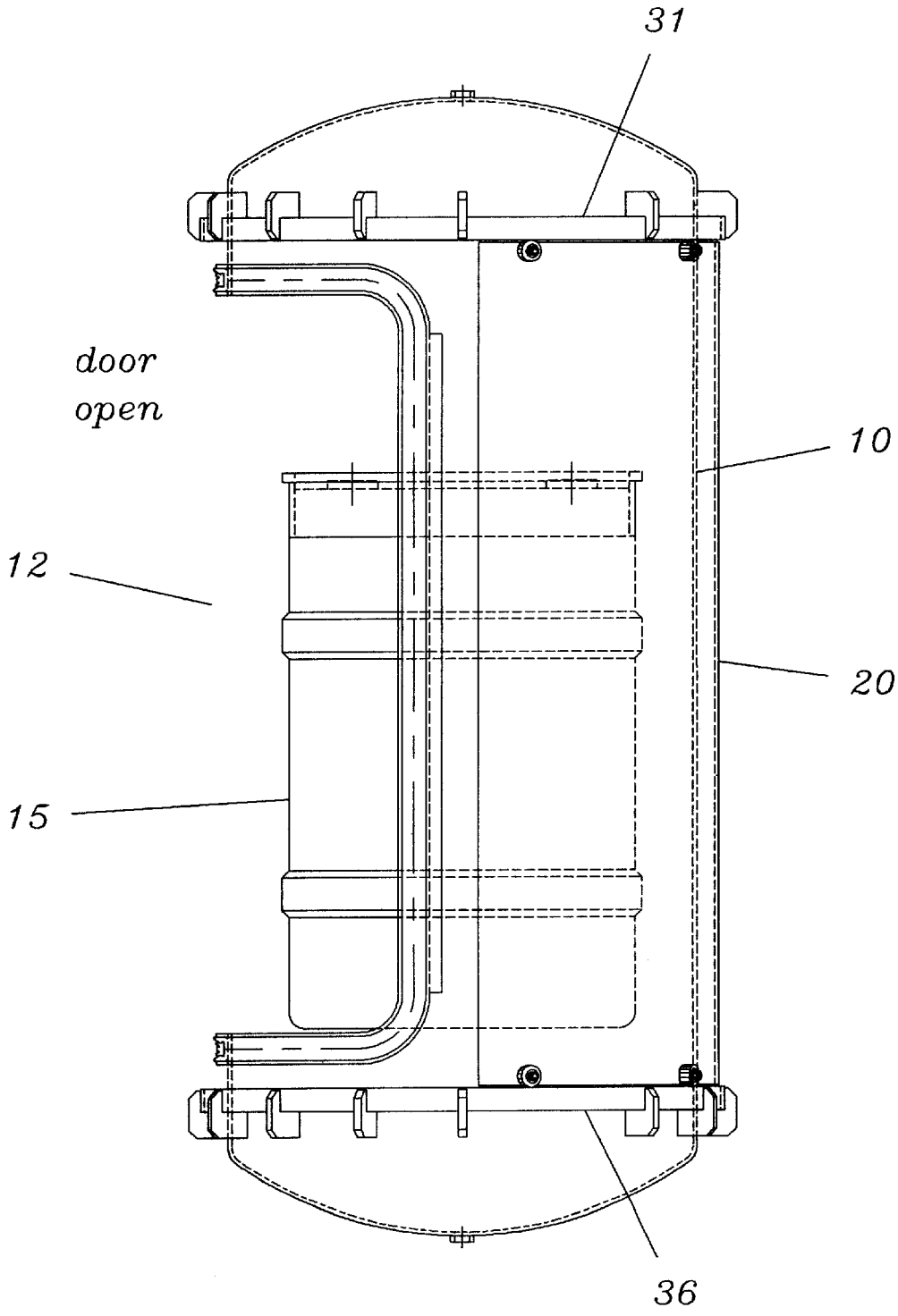
FIG. 10 is a side view of the pressurized tank of the present invention when the concentric door is open.

While the guide rollers and retaining ring mounting brackets provide a means to transfer forces from the top and bottom of the door to the tank body, they do not provide means to transfer forces from the sides of door 20 (leading edge 23*a* and trailing edge 23*b*). In order to transfer the forces of pressurization from the sides of the door to the pressurized tank 10, the closure assembly further comprises means for interlocking the door edges to the pressure vessel when the door is in the closed position. This interlocking means comprises a pair of door stops or restraining flanges provided along the length of each side of the door. Referring to FIGS. 4, 7 and 8, door stop 24*a* corresponds to the leading edge 23*a* and door stop 24*b* corresponds to the trailing edge 23*b* of the door 20. In this manner, the entire length of the leading edge 23*a* slides under door stop 24*a* and the entire length of trailing edge 23*b* slides under door stop 24*b*, thereby interlocking the door 20 to the tank 10 when the door is in the closed position.

The closure assembly further comprises a pneumatic seal 18 as shown in FIGS. 4 to 6 that is disposed within the void between the door perimeter and the tank. Once door 20 is closed and interlocked to the tank 10, the seal 18 is inflated from a remote pneumatic pressure source (not shown), such that the door 20 is pressed against door stops 24*a* and 24*b*, thereby transferring the forces from the pressurization of the tank the door 20 to the tank body.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A pressure vessel and closure assembly combination, said closure assembly comprising a concentric guide track having an upper concentric track and a lower concentric track, said upper track and said lower track each secured to the external surface of said pressure vessel, a concentric door configured to conform to the curvature of said pressure vessel, said concentric door having a top portion retained within said upper track by a plurality of upper door retaining guide rollers and a bottom portion retained within said lower track by a plurality of lower door retaining guide rollers, means for interlocking said concentric door to said pressure vessel, and an inflatable seal disposed within the void between the entire perimeter of said door and said pressure vessel when said door is closed and interlocked to said pressure vessel, wherein when said inflatable seal is inflated to fill the void between the entire perimeter of said concentric door and said pressure vessel, and said pressure vessel is pressurized, the resulting forces of pressurization against said top portion and said bottom portion of said concentric door are transferred to said pressure vessel by said upper door retaining guide rollers and said lower door retaining guide rollers.

2. The combination in accordance with claim 1, wherein said upper concentric track is secured to said pressure vessel by a plurality of first retaining ring mounting brackets and said lower concentric track is secured to said pressure vessel by a plurality of second retaining ring mounting brackets.

3. The combination in accordance with claim 2, wherein said concentric door is supported on said lower concentric track by a plurality of door support guide rollers which are mounted horizontally and radially from the center of said pressure vessel.

4. The combination in accordance with claim 3, wherein said upper retaining guide rollers and said lower door retaining guide rollers are mounted vertically to said top portion and said bottom portion of said concentric door respectively.

5. The combination in accordance with claim 4, wherein a plurality of upper door guide rollers are secured to said top portion of said concentric door and are mounted horizontally and radically from the center of said pressure vessel.

6. The combination in accordance with claim 5, wherein when said concentric door is in a closed position, said upper door retaining guide rollers are aligned with said plurality of first retaining ring mounting brackets and said lower door retaining guide rollers are aligned with said plurality of second retaining ring mounting brackets.

7. The combination in accordance with claim 1, wherein said concentric door comprises a side leading edge and a side trailing edge.

8. The combination in accordance with claim 7, wherein said means for interlocking said concentric door to said pressure vessel comprises a first door restraining flange corresponding to the length of said leading edge of said concentric door and a second restraining flange corresponding to the length of said trailing edge of said concentric door, said first and second door restraining flanges being configured in such a manner that said leading and trailing edges of said concentric door slide under said respective first and second restraining flanges thereby interlocking said concentric door to said pressure vessel.

9. The combination in accordance with claim 8, wherein when said inflatable seal is inflated to fill the void between the entire perimeter of said concentric door and said pressure vessel and said pressure vessel is pressurized, the resulting forces of pressurization against said side edges of said concentric door are transferred to said pressure vessel by said first and second door restraining flanges.

10. A pressure vessel and closure assembly combination, said closure assembly comprising:

(a) a concentric guide track comprising an upper track secured to the external surface of said pressure vessel by a plurality of first retaining ring mounting brackets and a lower track secured to the external surface of said pressure vessel by a plurality of second retaining ring mounting brackets;

(b) a concentric door configured to conform to the curvature of said pressure vessel, said door having a top portion, a bottom portion, a leading edge and a trailing edge, said top portion being retained within said upper track by a plurality of upper door retaining guide rollers, said bottom portion being retained within said lower track by a plurality of lower door retaining guide rollers, said upper and lower door retaining guide rollers being mounted vertically to said top portion and said bottom portion respectively;

(c) means for interlocking said concentric door to said pressure vessel comprising a first door restraining flange corresponding to the length of said leading edge of said concentric door and a second restraining flange corresponding to the length of said trailing edge of said concentric door, said first and second door restraining flanges being configured in such a manner that said leading and trailing edges of said concentric door slide under said respective first and second restraining flanges thereby interlocking said concentric door to said pressure vessel; and (d) an inflatable seal disposed within the void between the perimeter of said concentric door and said pressure vessel when said door is closed and interlocked to pressure vessel, wherein when said inflatable seal is inflated to fill the void between the entire perimeter of said concentric door and said pressure vessel, and said pressure vessel is pressurized, the resulting forces of pressurization against said top portion, said bottom portion, said leading edge and said trailing edge of said concentric door are transferred to said pressure vessel by said upper and lower door retaining guide rollers and said first and second door restraining flanges.

11. The combination in accordance with claim 10, wherein when said concentric door is in a closed position, said upper door retaining guide rollers are aligned with said plurality of first retaining ring mounting brackets and said lower door retaining guide rollers are aligned with said plurality of second retaining ring mounting brackets.

12. The combination in accordance with claim 11, wherein when said concentric door is in a closed position, said upper door retaining guide rollers are aligned with said plurality of first retaining ring mounting brackets and said lower door retaining guide rollers are aligned with said plurality of second retaining ring mounting brackets.

13. The combination in accordance with claim 10, wherein said concentric door is supported on said lower concentric track by a plurality of door support guide rollers which are mounted horizontally and radially from the center of said pressure vessel.

14. The combination in accordance with claim 10, wherein a plurality of upper door guide rollers are secured to said top portion of said concentric door and are mounted horizontally and radially from the center of said pressure vessel.

* * * * *